US008960335B2

(12) United States Patent
Hahati et al.

(10) Patent No.: US 8,960,335 B2
(45) Date of Patent: Feb. 24, 2015

(54) BIT FOR DRILLING WELLS AND ASSOCIATED DRILLING METHOD

(75) Inventors: Abdelhakim Hahati, Evere-Bruxelles (BE); Sébastian Desmette, Thieusies (BE); Benoît Deschamps, Gottignies (BE); Robert Delwiche, Brussels (BE); Matthieu Naegel, Strasbourg (FR)

(73) Assignee: Total S.A., Courbevoie (FR)

( * ) Notice: Subject to any disclaimer, the term of this patent is extended or adjusted under 35 U.S.C. 154(b) by 0 days.

(21) Appl. No.: 12/596,995

(22) PCT Filed: Apr. 22, 2008

(86) PCT No.: PCT/IB2008/002299

§ 371 (c)(1),
(2), (4) Date: Oct. 22, 2009

(87) PCT Pub. No.: WO2008/149240

PCT Pub. Date: Dec. 11, 2008

(65) Prior Publication Data

US 2010/0133013 A1 Jun. 3, 2010

(30) Foreign Application Priority Data

Apr. 23, 2007 (FR) ..... 07 02919

(51) Int. Cl.
*E21B 10/02* (2006.01)
*E21B 10/48* (2006.01)
*E21B 10/55* (2006.01)

(52) U.S. Cl.
CPC ..... *E21B 10/485* (2013.01); *E21B 10/55* (2013.01)
USPC ..... 175/404

(58) Field of Classification Search
CPC ..... E21B 10/04; E21B 10/605; E21B 10/48; E21B 25/10
USPC ..... 175/398, 404, 405.1, 403, 332, 333
See application file for complete search history.

(56) References Cited

U.S. PATENT DOCUMENTS

| | | | | |
|---|---|---|---|---|
| 2,931,630 A * | 4/1960 | Grady | 175/405.1 |
| 2,990,897 A * | 7/1961 | Short | 175/405.1 |
| 3,127,946 A * | 4/1964 | Deely | 175/404 |
| 3,552,505 A * | 1/1971 | Thompson et al. | 175/57 |
| 3,727,704 A | 4/1973 | Abplanalp | |

(Continued)

FOREIGN PATENT DOCUMENTS

| | | |
|---|---|---|
| BE | 1014561 A3 | 12/2003 |
| EP | 0346924 A2 | 12/1989 |

(Continued)

*Primary Examiner* — Shane Bomar
*Assistant Examiner* — Kipp Wallace
(74) *Attorney, Agent, or Firm* — Marsh Fischmann & Breyfogle LLP; Jonathon A. Szumny

(57) ABSTRACT

A bit for drilling wells has a front face with radial blades having cutting elements distributed around the front face. A space for forming a core is situated at the center of the front face. A cavity is provided for evacuating the core towards a periphery of the bit. At least a portion of the cavity is situated between adjacent blades. The cavity is delimited by two lateral surfaces and a clearance surface set back with respect to the front face, and the cavity is open in a direction opposite the clearance surface. The bit may be used in methods for drilling wells and makes it possible to rapidly drill wells of great depth in all types of rock without the risk of clogging.

22 Claims, 3 Drawing Sheets

(56) References Cited

U.S. PATENT DOCUMENTS

Figure 1:
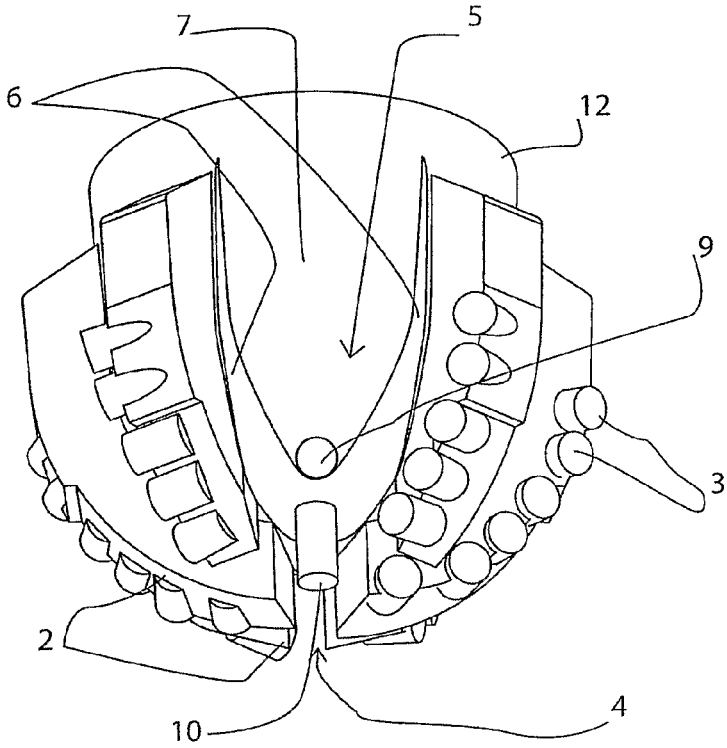

| | | | | |
|---|---|---|---|---|
| 3,743,036 | A * | 7/1973 | Feenstra et al. | 175/405.1 |
| 3,853,189 | A | 12/1974 | Cortes et al. | |
| 3,861,478 | A | 1/1975 | Condolios et al. | |
| 4,538,691 | A | 9/1985 | Dennis | |
| 4,694,916 | A * | 9/1987 | Ford | 175/249 |
| 4,989,578 | A | 2/1991 | Lebourg | |
| 5,016,718 | A * | 5/1991 | Tandberg | 175/333 |
| 5,655,614 | A * | 8/1997 | Azar | 175/404 |
| 2006/0266552 | A1 * | 11/2006 | Hutchinson | 175/50 |

FOREIGN PATENT DOCUMENTS

| | | | |
|---|---|---|---|
| FR | 2141510 | A | 1/1973 |
| FR | 2197325 | A | 3/1974 |

* cited by examiner

BIT FOR DRILLING WELLS AND ASSOCIATED DRILLING METHOD

The present invention relates to a bit for drilling wells, and in particular cylindrical wells of great depth such as mine shafts, oil or gas wells. The present invention also relates to a method for drilling wells using the bit.

The bit is a drilling tool intended to be installed at the end of a drill pipe string for drilling wells into a reservoir. By reservoir, is meant rock which is sufficiently porous and permeable to be able to contain fluids (water, oil, gas). These fluids can optionally accumulate to form a deposit. A drill pipe string is supported by a metal derrick and is rotated by a rotary table.

The drilling mud, a specific mixture of clay, water and chemical products is continuously injected into the inside of the drill pipes then emerges via the bit and returns to the surface via annular space contained between the drill pipes and the walls of the well. The circulation of the drilling mud cools the bit and allows the cuttings to be evacuated. At the surface, the drilling mud is filtered and reinjected. Analysis of the cuttings provides invaluable information on the nature and composition of the rocks cut through.

Thirty years ago, the drilling of a well of great depth could take several months. Also, in order to accelerate the drilling speed, bits have been proposed that do not drill at the centre of wells. In fact, the circumferential linear speed of the bit decreases from the periphery of the bit towards its centre and is zero at the centre of the bit. Thus, by not drilling the centre of the wells, the bits have gained efficiency. However, this type of bit produces a core in its centre, which must be broken up or evacuated.

Various types of bits which do not drill the centre of wells are known.

In particular, a bit is known from document U.S. Pat. No. 2,931,630 comprising an array in the surface of which a plurality of diamonds is mounted. This bit comprises moreover a cavity for receiving a core, the core being periodically broken off and evacuated by moving towards the outside and above the bit. The array in which the plurality of diamonds is mounted makes it possible to drill through hard and very hard rocks. However, if the bit encounters soft rock, the spaces situated between the diamonds become clogged and the tool can no longer drill. Now, during the drilling of wells of great depth, different types of geological formations are passed through by the bit and it is highly probable that soft rock will be encountered. This type of tool is therefore not suitable for drilling wells of great depth.

Bits provided with a chamber for crushing the core formed are known from the documents FR-A-2 141 510 and FR-A-2 197 325. However, if the bit encounters soft rock, the crushing chamber becomes clogged. The bit provided with a crushing chamber must then be brought out so that the bit can be cleaned, which leads to a significant loss of time.

From the document BE-A-1 014 561 a bit is also known, provided with a means or a device suitable for destroying the core in a progressive or continuous fashion or periodically, this means or this device being situated in the central zone of the body of the bit. In one embodiment, the means for destroying the core is the side wall of the central zone of the body of the bit. The core is then broken periodically under the effect of transmitted mechanical vibrations. However, if the bit encounters soft rock, the central zone of the bit becomes clogged. It must then be brought out to be cleaned, which leads to a considerable loss of time.

The purpose of the invention is therefore to propose a bit which makes it possible to rapidly drill wells of great depth in all types of rocks without the risk of clogging.

This purpose is achieved by a bit for drilling wells comprising:

- a front face,
- a plurality of radial blades provided with cutting elements, the blades being distributed around the front face,
- a space for forming a core, the space being situated at the centre of the front face,
- a cavity for evacuating the core towards the periphery of the bit, the cavity being situated between two adjacent blades.

According to another feature, the cavity is delimited by two lateral surfaces and a clearance surface, the clearance surface being set back with respect to the front face.

According to another feature, the clearance surface is suitable for evacuating the core simultaneously towards the periphery and towards the rear of the bit.

According to another feature, the bit further comprises a device for breaking up the core.

According to another feature, the breaking device is situated in the cavity close to the centre of the bit.

According to another feature, the breaking device is a tip made of an abrasion-resistant material.

According to another feature, the tip is inclined with respect to the axis of the bit.

According to another feature, the dimensions of the cavity are suitable for forming cylindrical cores the length of which is equal to at least twice their diameter.

According to another feature, the bit further comprises drilling mud feed channels, each of the channels opening onto the front face.

According to another feature, one of the channels opens into the cavity and is suitable for facilitating the evacuation of the core towards the periphery of the bit. According to another feature, the bit further comprises an element for radially cutting the core.

Another purpose of the invention is to provide a method for drilling wells using the bit described above, comprising the steps consisting of:

- forming a core at the centre of the bit,
- evacuating the core up through the drilling well to the ground surface,
- recovering the core.

According to another feature, the drilling method comprises, moreover, a step of analyzing the petrophysical properties of the core.

Figure 2:
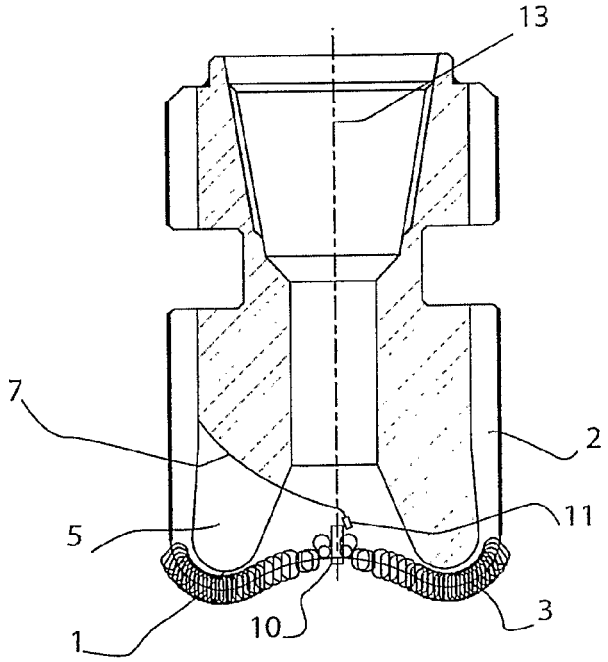
Figure 3:
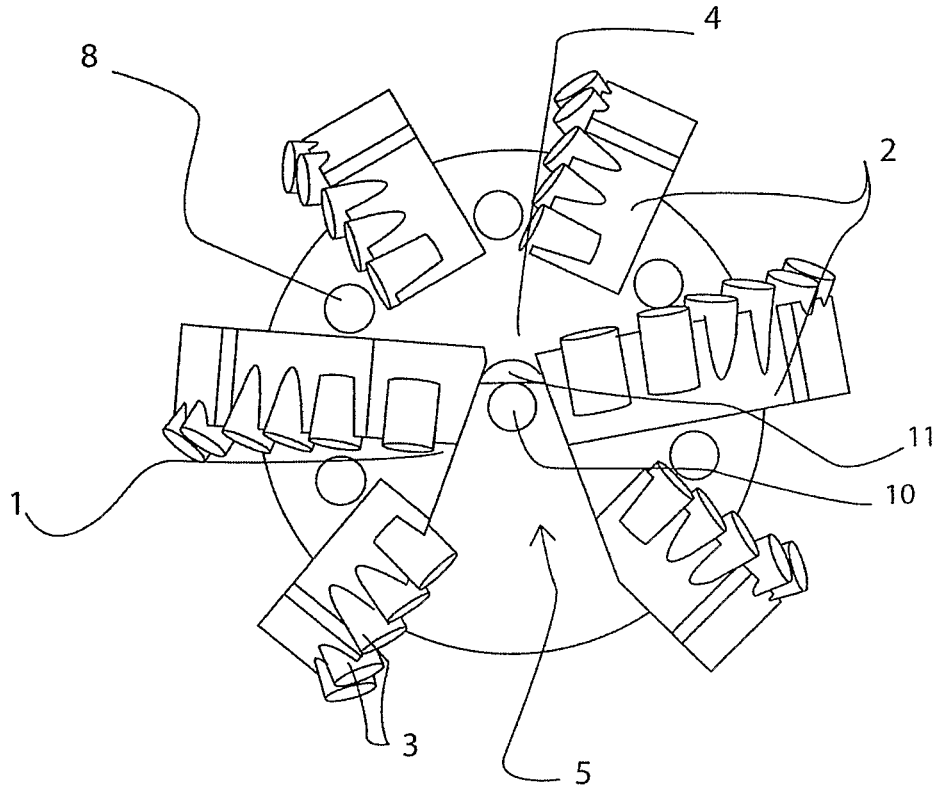
Figure 4:
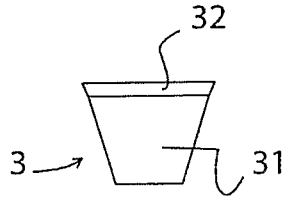
Figure 5:
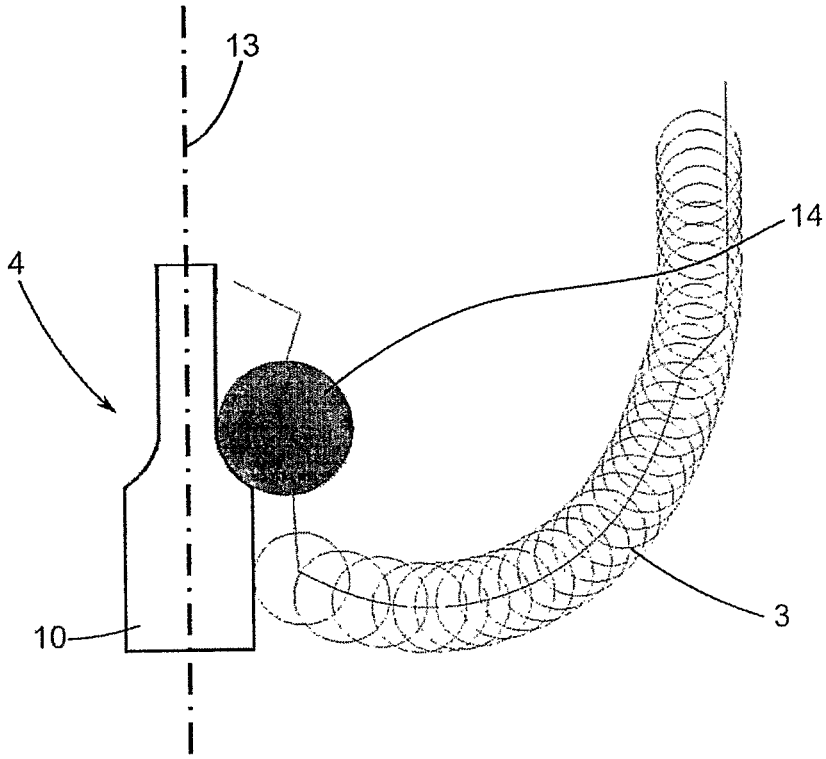

Other characteristics and advantages of the invention will become apparent on reading the following detailed description of the embodiments of the invention, given by way of example only and with reference to the drawings, which show:

FIG. 1, a perspective view of a bit (PDC tool) according to the invention,

FIG. 2, a longitudinal cross-section view of a bit (impregnated tool) according to the invention, FIG. 3, a front view of a bit (PDC tool) according to the invention, FIG. 4, a side view of a cutting element, FIG. 5, a longitudinal cross-section view of the front face of the bit.

A bit according to the invention comprises a front face. The bit also comprises a plurality of radial blades provided with cutting elements, the blades being distributed around the front face. The blades, provided with cutting elements, make it possible to drill, by shearing, in all types of rocks, thus avoiding clogging of the blades. A space situated at the centre of the front face allows the formation of a core at the centre of the bit. The formation of a core at the centre of the bit makes rapid drilling possible. A cavity situated between two adjacent blades of the bit allows the core to be evacuated towards the periphery of the bit. Thus, the evacuation of the core prevents any clogging inside the bit. The bit according to the invention therefore allows the rapid drilling of wells of great depth in all types of rocks without the risk of clogging. Identical reference numbers in the different figures represent identical or similar elements.

FIG. 1 represents a perspective view of a bit according to the invention. The bit comprises a body 12 having a rotational symmetry about an axis 13. The bit is suitable for mounting on a drill pipe string and being rotationally driven by different types of motor, on the surface or bottom, for example a motor with a spiral shaft (for example of Moineau type) or a turbine.

The front of the bit is defined as the part of the bit which is orientated towards the bottom of the well and the rear of the bit as the part of the bit which is orientated towards the outside of the well, i.e. in the case of vertical drilling, the earth's surface.

Moreover, the inside of the bit is defined as the part of the bit situated close to the axis 13 and the outside of the bit as the part of the bit situated close to the periphery of the bit.

The body 12 of the bit comprises a front face 1, which is preferably rounded so as to facilitate the penetration of the bit into the rocks as well as to provide the tool with satisfactory stability. The front face 1 is provided with a plurality of blades 2, for example 4, 6 or 8 blades, or even many more, for example 36. The harder the rocks to be drilled, the higher the number of blades.

The blades 2 are arranged in a substantially radial fashion, as can be seen in particular in FIG. 3. The blades extend along the outside wall of the body 12. The blades 2 project with respect to the front face 1 and to the outside wall of the body 12. Each blade 2 comprises a plurality of cutting elements 3 arranged alongside each other along the blade. The cutting element of a blade which is closest to the centre of the tool is called the inside cutting element of a blade. And the cutting element of a blade which is closest to the periphery of the tool is called the outside cutting element. Each cutting element 3 has a substantially cylindrical shape. The cutting elements 3 are mounted in the blades 2.

Each cutting element 3 is composed of material based on various metals including, for example, tungsten carbide (WC).

In a first embodiment, the metal-based material, with or without tungsten carbide, is impregnated with synthetic diamond, or even natural diamond, grains of varying sizes, ranging for example from 0.2 mm to 2 mm. A tool provided with cutting elements according to this first embodiment is called an "impregnated tool". In a second embodiment, illustrated in particular in FIG. 4, a layer of polycrystalline diamond compact, PDC, 32 is situated on the face of a stud 31 made of case-hardened tungsten carbide. This layer of PDC comprises a small quantity of metal so as to ensure its shock-resistance. A tool provided with cutting elements according to this second embodiment is called a "PDC tool".

The cutting elements of the impregnated tools and PDC tools are very hard and thus make it possible to drill rocks of variable hardness and in particular very hard rocks. The cutting elements are suitable for breaking rocks by shearing, which also makes them suitable for drilling in soft rocks.

The body 12 and the blades 2 of the bit are for example made of steel or infiltrated WC. They are preferably made of steel as this material is more resistant than infiltrated WC. Steel therefore allows more varied geometries of the bit, making it easier to adapt to the ground to be drilled.

Moreover, the blades 2 are arranged on an external annular crown of the front face 1. A space 4 is thus situated approximately at the centre of the front face 1. This space 4 is situated approximately at the intersection of the planes of the blades. This space is delimited by the inside cutting elements of each blade. When the bit is driven into the rock while rotating, a substantially cylindrical core 10 is formed in this space 4.

Moreover, the bit comprises an evacuation cavity 5 situated between two adjacent blades 2. This evacuation cavity 5 is suitable for evacuating the core towards the periphery of the tool. The evacuation cavity 5 is delimited by two lateral surfaces 6 and a clearance surface 7. The lateral surfaces are substantially parallel, even merged, with the lateral surfaces of the two blades adjacent to the cavity. The angle between the adjacent blades, between which the cavity is formed, is for example comprised between 45° and 90°. This angle is a function of the diameter of the tool and that of the core formed. The clearance surface 7 is set back with respect to the front face 1. The clearance surface can be seen particularly well in FIG. 2. The clearance surface 7 extends from the space 4 to the periphery of the bit. The base of the space 4 is situated in the cavity 5. The clearance surface 7 rises towards the rear of the bit, and extends along the tool guard. Thus, the clearance surface 7 allows the core 10 to be guided simultaneously towards the periphery of the bit (which is facilitated by centrifugal force) and towards the rear of the bit (which is facilitated by the forward movement of the tool and by the drilling mud) in order to evacuate it into the well. Once the core is evacuated from the cavity 5, it rises with the drilling mud to the earth's surface.

Moreover, the bit comprises a breaking device 11, suitable for causing the core to break by shearing. The breaking device 11 is situated on the clearance surface 7 of the cavity 5, close to the centre of the bit. The breaking device 11 is for example fixed onto this clearance surface 7, for example by crimping. During the formation of the core, the length/diameter ratio of the core increases. The longer the core becomes, the more the latter weakens. Therefore a small lateral pressure is sufficient to cause it to break. The breaking device 11 can therefore be any device which is capable of producing such a lateral pressure. The breaking of the core occurs when the core attains a length which is determined by the depth of the space 4 (namely the distance between the front of the blades 2 and the evacuation cavity 5 at the centre of the bit) and the positioning of the breaking device 11 with respect to the axis 13 of the bit.

The breaking device is for example made of an abrasion-resistant material, for example a metal-based material, with or without tungsten carbide, diamond impregnated, or of PDC, or also of ceramic or of a carbide-based material. The breaking device 11 is for example in the form of a tip. The tip is arranged according to an axis which is inclined with respect to the axis 13 of the bit, as can be seen in particular in FIG. 2. The angle between the plane of the tip and the axis of the bit is for example comprised between 10° and 15°.

The dimensions of the core 10 are limited by the geometry of the bit, and in particular by the geometry of the space 4 and the cavity 5.

Moreover, the bit comprises channels 8, 9, which can be seen in particular in FIG. 3, which are suitable for conveying drilling mud, the drilling mud making it possible to cool the bit down and to raise the rock cuttings up through the well to the earth's surface.

The drilling mud also makes it possible to raise the cores formed in the bit up to the earth's surface.

Economic investments in the oil industry mean that it must be possible to realistically describe the geological structure of wells and reservoirs, for example by having access to the petrophysical properties (porosity, permeability, etc.) of the rocks constituting the wells and the reservoirs. These properties are not uniform in any reservoir, but depend on the geological structures which constitute it. This results in reservoir heterogeneity. Knowledge of the reservoir involves the determination of such heterogeneities. The characterization of wells and reservoirs makes it possible to offer assistance in deciding on the evolution of development of the deposit and more generally, it makes it possible to provide assistance as regards the exploitation of the deposit and the drilling of wasteland.

In the case of wells of great depth (typically 5-6 km), the pressures and temperatures at the bottom of wells are such that it is impossible to carry out standard characterizations such as standard loggings or corings. In fact, the electronics used for loggings is not resistant to high pressures (7800 bar or more) and high temperatures (150° C. or more). In addition, the standard coring is very restricting as it assumes that the core obtained is raised to the surface every 10 to 40 m of drilling.

Also, it is particularly useful to be able to continuously raise to the surface the cores formed by the bit according to the invention in order to be able to carry out the characterizations of the wells at the surface. It is also advantageous for the cores to be of a length which is sufficiently great to be able to extract a maximum amount of information on the geological structure of the well.

In order that the core 10 is raised to the surface as intact as possible, it is necessary that the breaking device 11 does not crush it, but shears it.

It has been observed that the core is sheared and not crushed when the length/diameter ratio is at minimum equal to 2. The dimensions of the evacuation cavity 5 must therefore be at least equal to the greatest dimension of the core, i.e. its length.

The cores obtained by the bit according to the invention have a length of the order of 10 to 100 mm.

In the case where the rocks to be drilled are hard, the bit comprises a higher number of blades than in the case where the rocks to be drilled are softer. The outside diameter of the bit is for example 21.59 cm (8.5") for a bit with 8 blades, 15.24 cm (6") for a bit with 6 blades and 66.04 cm (26") for a tool with 36 blades.

For a bit with 8 blades with a diameter of 21.59 cm, cores of length 35 mm and diameter 15 mm have been obtained.

For a bit with 6 blades with a diameter of 15.24 cm, cores of length 30 mm and diameter 10 mm have been obtained.

The maximum diameter that can be envisaged for a core is approximately equal to one-third of the outside diameter of the bit. In order to be able to exploit the cores satisfactorily, it is desirable for the diameter of the core to be at minimum equal to 5 mm.

Moreover, the presence of a core at the centre of the bit has a stabilizing effect on the bit. The greater the diameter of the cores, the more stable the bit during drilling.

Moreover, the cylindrical shape of the core makes it possible to provide a directional reference, the axis of the core corresponding to the axis of the well drilled.

The core 10 is sheared by the breaking device 11 of the bit, then evacuated in cavity 5 towards the periphery of the bit then raised up through the well to the earth's surface with the drilling mud.

The bit comprises for example a number of channels 8, 9 supplying drilling mud, equal to the number of blades. The channels 8, 9 open out onto the front face 1 of the bit.

One of the channels 9 opens into the cavity 5 close to the centre of the bit and the breaking device 11. This channel 9 facilitates the evacuation of the core in the cavity along the clearance surface 7 towards the periphery of the bit. During its evacuation via the cavity, the core is thus steeped in the drilling mud. This reduces the risk of the core knocking against the lateral walls 6 or the clearance surface of the cavity is reduced. The core is therefore less likely to break up.

The orifices of the other channels 8 are arranged substantially around an axial crown, as can be seen in particular in FIG. 3.

Another embodiment is illustrated in particular in FIG. 5, which represents a longitudinal cross-section view of the front face of the bit. FIG. 5 shows the cutting elements 3 mounted on a blade. Inside the bit, along the axis 13, a core 10 is represented in the process of being created in the space 4. According to FIG. 5, the dimensions of the space 4 are increased. This allows higher drilling speeds to be achieved. Moreover, the bit comprises a component 14 for radially cutting the core. The component 14 can be situated at the centre of the bit. The component can be arranged laterally with respect to the space 4. This component is presented, for example, according to the cutting element 3 described above. The component 14 is for example mounted in the bit, the rotation of the bit making it possible to reduce the diameter of the core by cutting the core with the component 14. The reduction in the diameter of the core makes it possible not only to raise the core to the surface more easily, but also to raise the core without damaging it. Therefore, it is possible to increase the size of the space 4, and thus guarantee rapid drilling, while keeping a core intact. By way of example, it is possible to use a bit with 6 blades (6") having a space 4 with a 20 mm diameter. Starting with a core diameter of 20 mm, the component 14 makes it possible to obtain a core of 8 mm.

The invention also relates to a method for drilling wells using the bit according to the invention. The method comprises the steps consisting of:

forming a core at the centre of the bit, evacuating the core up through the well to the ground surface, recovering the core, for example in a sieve.

The drilling method also comprises the step consisting of analyzing the petrophysical properties of the core.

The drilling method also comprises the step consisting of analyzing the mechanical properties of the core.

The invention claimed is:

1. A bit for drilling wells comprising:

a front face, a plurality of radial blades provided with cutting elements, the blades being distributed around the front face and being arranged on an external annular crown of the front face, a space for forming a cylindrical core, the space being situated at the center of the front face, a cavity for evacuating the cylindrical core without crushing said cylindrical core towards a periphery of the bit, a majority of the cavity being situated between two adjacent of said blades, the cavity being delimited by two lateral surfaces and a clearance surface set back with respect to the front face and the cavity being open in a direction substantially perpendicular to the clearance surface along a substantial entirety of a length of the clearance surface, and drilling mud feed channels, each of the channels opening onto the front face, wherein one of said channels opens into the cavity and is suitable for facilitating the evacuation of the cylindrical core towards the periphery of the bit, without crushing said cylindrical core.

2. A bit according to claim 1, wherein the clearance surface is suitable for evacuating the cylindrical core simultaneously towards the periphery and towards the rear of the bit.

3. A bit according to claim 1, further comprising a device for breaking up the cylindrical core.

4. A bit according to claim 3, wherein the device is situated in the cavity close to the center of the bit.

5. A bit according to claim 4, wherein the device is a tip made of an abrasion-resistant material.

6. A bit according to claim 5, wherein the tip is inclined with respect to the axis of the bit.

7. A bit according to claim 1, wherein the dimensions of the cavity are suitable for forming cylindrical cores the length of which is equal to at least twice their diameter.

8. A bit according to claim 1, further comprising an element for radially cutting the cylindrical core.

9. A bit according to claim 1, the bit having a front that orients toward a bottom of a well during use, wherein the cavity extends, and is exposed toward the front of the bit, from the space to the periphery of the bit.

10. A bit according to claim 9, wherein the channel that opens into the cavity opens into the cavity adjacent the space.

11. A bit according to claim 1, wherein the bit comprises a body including an outside wall and the front face, wherein each of the blades extends along the outside wall and the front face, and wherein each of the blades is connected to the outside wall and the front face and projects away from the outside wall and the front face.

12. A bit according to claim 11, wherein each of the blades extends substantially perpendicularly away from the outside wall and the front face.

13. A bit according to claim 11, wherein each of the blades is separated from adjacent ones of the blades along substantially an entire thickness of each of the blades that extends between the outside wall and the cutting elements.

14. A bit for drilling wells comprising:

a front face, a plurality of radial blades provided with cutting elements, the blades being distributed around the front face and being arranged on an external annular crown of the front face, a space for forming a cylindrical core, the space being situated at the center of the front face, a cavity for evacuating the cylindrical core without crushing said cylindrical core towards the periphery of the bit, a majority of the cavity being situated between two adjacent of said blades, the cavity being delimited by two lateral surfaces and a clearance surface set back with respect to the front face and the cavity being open in a direction substantially perpendicular to the clearance surface along a substantial entirety of a length of the clearance surface, a device for breaking up the cylindrical core, the device being situated in the cavity close to the center of the bit, and drilling mud feed channels, each of the channels opening onto the front face, wherein one of said channels opens into the cavity and is suitable for facilitating the evacuation of the cylindrical core towards the periphery of the bit, without crushing said cylindrical core.

15. A bit according to claim 14, wherein the cavity is delimited by two lateral surfaces and a clearance surface, the clearance surface being set back with respect to the front face.

16. A bit according to claim 15, wherein the clearance surface is suitable for evacuating the cylindrical core simultaneously towards the periphery and towards the rear of the bit.

17. A bit according to claim 14, wherein the device is a tip made of an abrasion-resistant material.

18. A bit according to claim 17, wherein the tip is inclined with respect to the axis of the bit.

19. A bit according to claim 14, wherein the dimensions of the cavity are suitable for forming cylindrical cores the length of which is equal to at least twice their diameter.

20. A bit according to claim 14, further comprising an element for radially cutting the cylindrical core.

21. A method for drilling wells, the method comprising:

providing a bit for drilling wells, the bit comprising:

a front face, a plurality of radial blades provided with cutting elements, the blades being distributed around the front face and being arranged on an external annular crown of the front face, a space for forming a cylindrical core, the space being situated at the center of the front face, a cavity for evacuating the cylindrical core without crushing said cylindrical core towards the periphery of the bit, a majority of the cavity being situated between two adjacent of said blades, the cavity being delimited by two lateral surfaces and a clearance surface set back with respect to the front face and the cavity being open in a direction substantially perpendicular to the clearance surface along a substantial entirety of a length of the clearance surface, and drilling mud feed channels, each of the channels opening onto the front face, wherein one of said channels opens into the cavity and is suitable for facilitating the evacuation of the cylindrical core towards the periphery of the bit, without crushing said cylindrical core;

forming a cylindrical core at the center of the bit;

evacuating the cylindrical core up through the drilling well to the ground surface; and recovering the cylindrical core.

22. A method of drilling according to claim 21, further comprising a step of analyzing the petrophysical properties of the cylindrical core.

* * * * *